United States Patent [19]

Fluck et al.

[11] 4,171,201

[45] Oct. 16, 1979

[54] APPARATUS FOR THREADING UP AND PLACING A THERMOPLASTIC THREAD ON A HEATING DEVICE OF A TEXTILE MACHINE

[75] Inventors: Jakob Fluck, Winterthur; Eduard Schenkel, Seuzach, both of Switzerland

[73] Assignee: Rieter Machine Works, Ltd., Winterthur, Switzerland

[21] Appl. No.: 844,302

[22] Filed: Oct. 21, 1977

[30] Foreign Application Priority Data

Oct. 28, 1976 [CH] Switzerland ..... 13581/76

[51] Int. Cl.[2] ..... F27B 9/28

[52] U.S. Cl. ..... 432/59; 219/388

[58] Field of Search ..... 432/8, 59; 219/388, 219/388 S; 57/34 HS, 51.5

[56] References Cited

U.S. PATENT DOCUMENTS

| | | | |
|---|---|---|---|
| 3,559,255 | 2/1971 | Cockroft | 432/59 |
| 3,796,538 | 3/1974 | Howorth | 432/59 |
| 3,842,578 | 10/1974 | Schippers | 57/34 HS |

FOREIGN PATENT DOCUMENTS

| | | | |
|---|---|---|---|
| 1261991 | 2/1972 | United Kingdom | 432/266 |

*Primary Examiner*—John J. Camby

*Attorney, Agent, or Firm*—Kenyon & Kenyon

[57] ABSTRACT

A moveable thread guide element is disposed for movement from a thread receiving position located below a stationary thread guide pin element to a thread-transfer position engaged with the pin element. The moveable thread guide element is pivotally mounted so as to pivot upon engagement with the pin. This allows the thread on the moveable guide element to slide onto the pin element. After transfer, the moveable guide element can be lowered.

18 Claims, 6 Drawing Figures

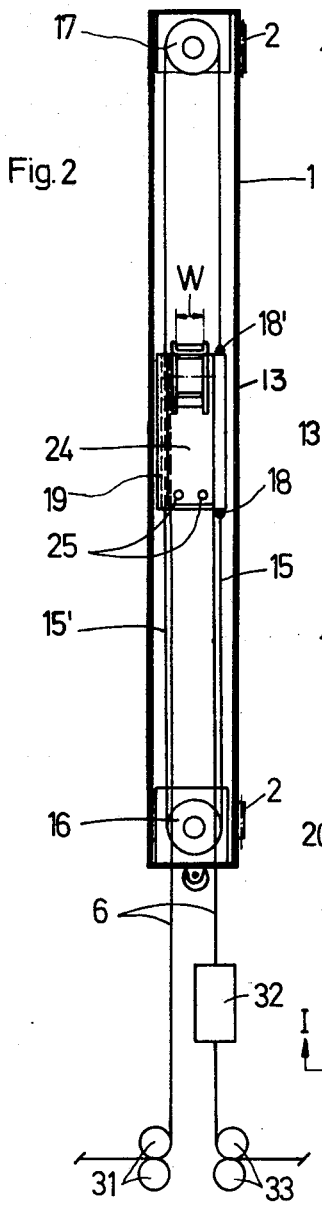
Fig. 2
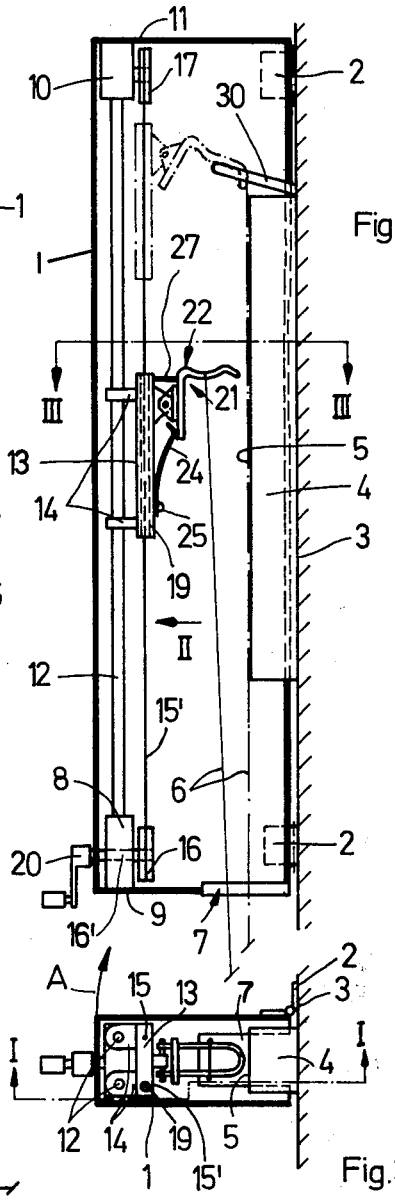
Fig.1
Fig.3

APPARATUS FOR THREADING UP AND PLACING A THERMOPLASTIC THREAD ON A HEATING DEVICE OF A TEXTILE MACHINE

This invention relates to a thread guide element for transferring thread. More particularly, this invention relates to an apparatus for threading up and placing a thermoplastic thread on a heating device within a textile machine.

Heretofore, various devices have been known for threading up and placing a thermoplastic thread in contact with a heating element of a heating device in textile machines. Generally, these devices first bring the thermoplastic thread into a position in front of the heating element and, thereafter, place the thread in contact with the heating element. One such device is described in Swiss Pat. No. 543,612 (see also French Pat. No. 2,160,102 and German DAS No. 21 55 514). As particularly shown in FIG. 7 of the Swiss Patent, the device has a rod which is disposed in front of a heating surface of a heating element for movement up and down between an uppermost position and a lowermost position in a manual manner. In addition, a lever is supported at the end of the rod and is pivotable towards the heating surface while, a thread guide roll is rotatably supported at the free end of the lever. In order to thread up and place a thread in contact with the heating device, the rod is first pulled down manually until the thread guide roll has reached the lowest position in which the thread can be placed manually onto the guide roll. Subsequently, the rod is moved to the uppermost position. As the rod moves towards the uppermost position, the lever is pivoted by a stop in the direction of the heating surface. When in the uppermost position of the rod, the lever is pivoted towards the heating surface so that the thread, guided by the thread guide roll, is placed in contact with the heating surface.

However, these known devices have had certain disadvantages. First, one device per each thread path is required. Second, during operation, the threading device remains fixed in the zone of the heating surface so that the control of the thread passage is made substantially more difficult.

Accordingly, it is an object of the invention to provide an apparatus which can simply place one or more threads onto one or more heating surfaces of a heating device.

It is another object of the invention to provide a threading-up apparatus which is of relatively simple construction.

It is another object of the invention to provide a threading-up device wherein the thread passage can be controlled at all times without impediment.

Briefly, the invention provides an apparatus which can be used with a heating device of a textile machine for threading up and placing a thermoplastic thread in contact with a heating surface of the heating device. This apparatus comprises at least one stationary thread guide element which is mounted on a fixed axis above the heating surface for guiding the thread into contact with the heating surface, as well as a moveable thread guide element which is disposed for movement between a thread-receiving position located below the stationary thread guide element and a thread-transfer position located adjacent the stationary thread guide element. When in the thread-transfer position, a thread on the moveable thread guide element is transferred to the stationary thread guide element.

The apparatus cooperates with a means such as a pair of delivery rolls which are positioned below the heating device to place a thread in contact with the heating surface. Thus, the delivery rolls not only serve to deliver a thread to the threading-up apparatus but also cooperate with the stationary thread guide element to place a thread therebetween in contact with the heating surface.

The threading-up apparatus also includes a member having the moveable thread guide element pivotally mounted thereon as well as a means for moving the member between the thread-receiving position and the thread-transfer position.

In order to effect the pivoting of the moveable thread guide element, a stop is provided. This stop can be embodied in the stationary thread guide element. In addition, the moveable thread guide element can be constructed of a wire like element having a pair of legs which form a guide to hold a thread thereon and a loop which connects the legs at one end. The loop is positioned so as to be moveable in a path vertically aligned with the stationary pin so that upon engagement of the two guide elements, the loop partially surrounds the pin in the thread-transfer position with portions of the legs exposed above the pin. This allows sliding of the thread from the leg portions of the moveable thread guide element onto the pin.

These and other objects and advantages of the invention will become more apparent from the following detailed description and appended claims taken in conjunction with the accompanying drawings in which:

FIG. 1 illustrates a lateral view of a threading-up apparatus according to the invention taken on line I—I of FIG. 3;

FIG. 2 illustrates a front view of a threading-up apparatus of FIG. 1 as seen in the direction of arrow II in FIG. 1.

FIG. 3 illustrates a view taken on line III—III of FIG. 1;

Figure 4:
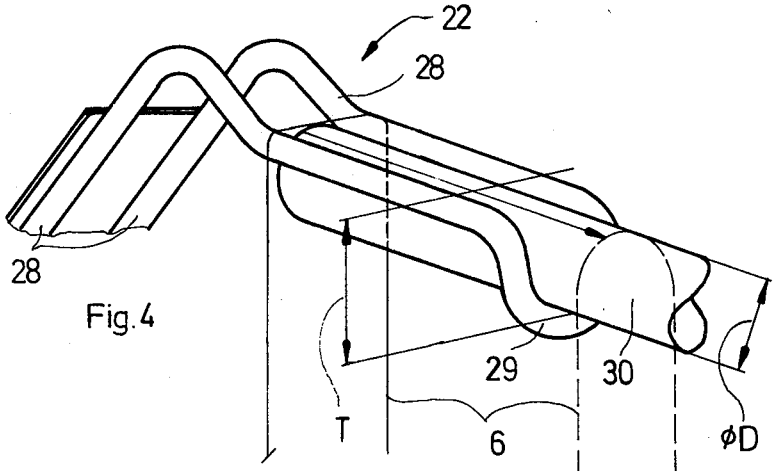
FIG. 4 illustrates an enlarged partial view of a moveable thread guide element in the thread-transfer position.

Referring to FIG. 1, a housing 1 is hinged via hinges 2 (only one of which is visible in FIGS. 3 and 5) on a rigid frame 3 of a textile machine, for example a crimping or texturizing machine (not shown). The housing 1 is thus pivotable or tiltable in the direction indicated by the arrow A (FIG. 3) so as to selectively enclose a heating device 4 mounted on the frame 3. This heating device 4 includes a heating surface 5 for the transfer of heat to an endless filament 6 such as a thermoplastic thread. As indicated by dash-dotted lines, the thread 6 contacts the heating surface 5 along the length of the thread. The lower end portion of the housing 1 has an opening 7 to permit the passage of the thread 6.

A threading-up apparatus for positioning the thread in contact with the heating surface 5 includes at least one stationary thread guide element in the form of a pin 30 which is mounted on a fixed axis above or adjacent the heating surface 5. The pin 30 may be rotatable about this axis or fixed against rotation. As shown, the pin 30 is mounted at an angle to the horizontal so that a loop of the thread 6 is able to slide down towards the heating surface 5. In addition, the threading-up apparatus has a moveable thread guide means or element 21 which is mounted on the housing 1 for movement between a thread-receiving position located below and remote from pin 30 and a thread-transfer position located adjacent to the pin 30 when the housing 1 is in a closed position. A means is a'so provided for moving the moveable thread guide element into the thread transfer position to engage with the pin 30. This means employs a lower support member 8 mounted on a lower wall 9 on the housing, an upper support member 10 mounted on an upper wall 11 of the housing, two parallel guide rods 12 which are mounted in the support members 8, 10, a sliding member 13 which is moveable along the guide rods 12 via slide shoes 14 fixed to the member 13, and a moving cord arrangement 15. As shown, the moving cord arrangement 15 employs a lower guide roll 16 which is rotatably supported in the lower support member 8 and an upper guide roll 17 which is rotatably supported in the upper support member 10. In addition, two cord ends 18, 18' are connected to opposite sides of the sliding member 13 and pass over the respective guide rolls 16, 17 while, a duct 19 is provided on the sliding member for the passage of one cord leg 15'. A crank 20 is connected with a shaft 16' which supports the roll 16 and is used for driving the moving cord arrangement 15. The friction between the moving cord and the roll 16 is chosen to be sufficiently large so that no slippage occurs between the moving cord arrangement 15 and the roll 16 during use.

Figure 6:
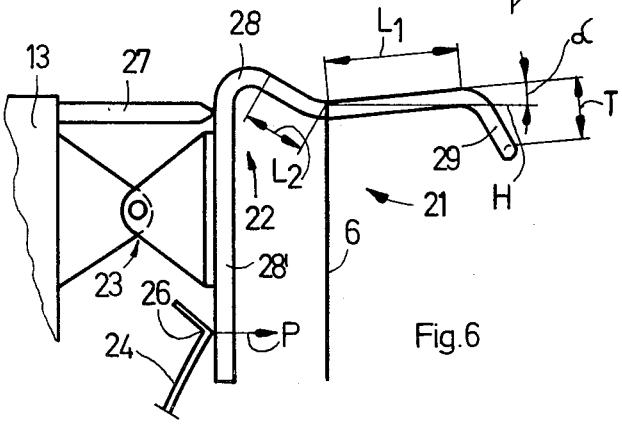
FIG. 6 illustrates an enlarged view of the moveable thread guide element of FIG. 1.

Referring to FIGS. 1 and 6, the moveable thread guide element is formed of a wire-like loop element 22 which is tiltably or pivotably mounted on the sliding member 13 via a pivot connection 23 so as to be moved between a first condition retaining a loop of thread thereon during movement between the thread-receiving and thread-transfer positions and a second condition allowing transfer of the loop to the pin 30 by sliding of the thread in a direction transverse to the plane of the loop. In addition, an abutment 27 is provided on the upper end of the member 13 for limiting the travel of the loop member 22 while a flat spring 24 is provided for biasing the loop member 22 against the abutment 27. This flat spring 24 exerts a predetermined spring force P onto the loop member 22 via an angled upper end while the lower end of the spring 24 is fixed via screws 25 to the sliding member 13 (FIG. 1). The spring force P is chosen such that the tension in the thread 6 cannot pivot the loop member 22 away from the abutment 27.

As shown in FIG. 4, the loop member 22 is formed of a pair of parallel legs 28 and a loop or portion 29 which interconnects the legs 28 at one end. The opposite ends of the legs 28 are connected as shown in FIG. 6 with the pivot device 23 in any suitable manner. Each of the legs 28 has two leg portions of differing lengths $L_1$, $L_2$ which define a guide for holding the thread 6 thereon. These leg portions are inclined towards one another and provide for a stable position of the thread 6. As indicated, the longer leg portions $L_1$ are inclined at an angle $\alpha$ of approximately ten degrees with respect to an imaginary horizontal plane H (FIG. 6). The legs 28 are also arranged at a mutual inside distance W (FIG. 2) which exceeds, for example by four millimeters, the diameter D (e.g. 10 millimeters) of the guide pin 30. The legs 28 are thus spaced to lie on either side of the pin 30 in the thread transfer position. In a similar manner, the loop 29 is bent downward in such a manner that the distance T (FIG. 4) exceeds the diameter D of the pin 30, for example by two millimeters.

In operation, in order to thread-up the thread 6 to a position in front of the heating device 4 and to place the thread 6 onto the heating surface 5 the following steps are effected.

First, the housing 1 is pivoted to an open position in the direction indicated by the arrow A (FIG. 3). Thereafter, the crank 20 is cranked until the sliding member 13 is located in the vicinity of the lower support member 8. Next, the thread 6 which is delivered by a pair of delivery rolls 31 is placed on the loop member 22 using, for example, a manually operated thread suction nozzle which is available on the market (e.g. manufactured by Teijin, Japan) which draws off the thread delivered by the delivery rolls 31. Subsequently, before transferring the thread to a winding device (not shown), the thread is threaded into subsequent elements corresponding to the method of processing, for example into a texturizing device 32 and through a pair of take-off rolls 33 (FIG. 1). Thereafter the housing 1 is pivoted into the closed position and the crank 20 is cranked until the loop member 22 reaches the guide pin 30. Upon engagement of the loop member 22 with the pin 30, the loop member 22 pivots downwardly into the thread-transfer position as shown in FIG. 4. The pin 30 thus functions as a stop to activate the pivoting of the loop member 22. The pivoting of the loop member 22 under the influence of the crank 20 overcomes the spring force P of the spring 24. The thread 6 is now allowed to slide from the legs 28 of the loop member 22 onto the pin 30 and continues to slide on the pin 30 into the position indicated with broken lines in FIG. 1. In this position, the thread 6 is in contact with the heating surface 5 of the heating device 4. Subsequently, the sliding member 13 is moved downward either to some slight degree or down to the thread-receiving position.

As the thread 6 is subject to an additional stretch or drawing process during the above described upward movement, the thread 6 can be lifted into close vicinity to the thread-transfer position before being transferred to the texturizing device 32 so as to reduce the drawing action to a minimum depending on the material of the thread being processed. In this position, the loop member 22 would be positioned close to the pin 30 without tilting of the loop member 22. The sliding member 13 can be held in this position by any suitable arresting or holding mechanism (not shown).

Figure 5:
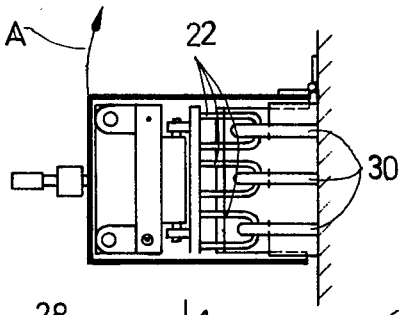
FIG. 5 illustrates a view similar to FIG. 3 of a modified threading-up apparatus in accordance with the invention.

Referring to FIG. 5, the threading-up apparatus may be employed with a plurality of loop members 22 for simultaneously placing a plurality of threads into contact with a heating surface. The dimensions of these elements are chosen to take into consideration only the juxta position of the loop members 22.

The invention thus provides a threading-up apparatus which is relatively trouble free during operation due to the simplicity of the various parts used. In addition, the apparatus allows a possibility of simultaneously placing a plurality of threads on a heating surface. Further, the invention allows the threading-up apparatus to be pivoted away from the heating defice. This allows the thread path on the heating device to be controlled during operation.

Instead of using the pin 30 as a stop, a separate stop may be used to effect movement of the loop member 22 from one condition to the other at the thread-transfer position as noted above. In the event that the heating device 4 is oriented in a horizontal plane, the various components of the threading-up apparatus would be accordingly disposed.

What is claimed is:

1. In combination with a heating device of a textile machine having a heating surface; an apparatus for threading up and placing a thermoplastic thread in contact with said heating surface; said apparatus comprising a first thread guide element mounted adjacent said heating surface for guiding a thread looped about said pin into contact with said heating surface, and a second thread guide means element disposed for movement between a thread-receiving position remote from said first thread guide element and a thread-transfer position located adjacent said first thread guide element, said second guide means being moveable between a first condition having a thread loop thereon during movement between said positions and a second condition in said thread-transfer position to allow transfer of the thread loop to said first guide element by movement of the thread in a direction transverse to the plane of the thread loop.

2. The combination as set forth in claim 1 which further comprises a pair of delivery rolls below said heating device for delivering a thread to said threading-up apparatus, said rolls and said thread guide element being disposed to place a thread therebetween in contact with said heating surface.

3. The combination as set forth in claim 1 wherein said apparatus includes a member having said thread guide means pivotally mounted thereon, and means for moving said member between said positions.

4. The combination as set forth in claim 3 which further includes a stop for pivoting said thread guide means in said thread-transfer position.

5. The combination as set forth in claim 3 wherein said thread guide means is pivotal upon engagement with said first thread guide element in said thread-transfer position.

6. The combination as set forth in claim 4 wherein said thread guide means includes a pair of legs forming a guide for holding a thread thereon between said positions, said legs being spaced to be on either side of said first guide element in said thread-transfer position to allow sliding of a thread from said legs onto said first thread guide element.

7. The combination as set forth in claim 6 wherein said thread guide means further includes a portion interconnecting said legs at one end, said portion engaging said stop in said thread-transfer position with portions of said legs being disposed above said first guide element to allow sliding of a thread from said legs onto said first guide element.

8. The combination as set forth in claim 7 wherein said portion is moveable in a path vertically aligned with said stop.

9. In combination with a heating device having a heating surface;

a hingedly mounted housing for selectively enclosing said heating device, a first thread guide element mounted above said heating surface for guiding a thread looped about said element into contact with said heating surface, a second thread guide element mounted on said housing for movement between a thread-receiving position located below said first thread guide element and a thread-transfer position located adjacent said first thread guide element with said housing in a closed position, said second guide element being moveable between a first condition retaining a loop of thread thereon during movement between said positions and a second condition allowing transfer of the loop to said first guide element by sliding of the thread in a direction transverse to the plane of the loop, and means for moving said second thread guide element into said thread-transfer position to engage with a stop to cause movement of said second guide element from said first condition to said second condition.

10. The combination as set forth in claim 9 wherein said second thread guide element is pivotally mounted to pivot upon engagement with said stop.

11. The combination as set forth in claim 10 wherein said second thread guide element includes a pair of legs forming a guide for holding a thread thereon and a portion interconnecting said legs at one end, said portion being sized to partially surround said stop and said legs being spaced to be on either side of said first guide element in said thread-transfer position with portions of said legs disposed above said first guide element to allow sliding of a thread from said legs onto said first guide element.

12. The combination as set forth in claim 10 which further includes an abutment for engaging said second guide element in said first condition and a spring biasing said second guide element against said abutment.

13. The combination as set forth in claim 1 wherein said second condition of said second guide means is such that the thread can slide from said second guide means onto said first guide element.

14. The combination as set forth in claim 1 wherein movement of said second guide means between said first and second conditions is caused by movement of said second guide means into said thread transfer position.

15. A thread guide element for transfering thread comprising a wire like element having a pair of parallel legs each having adjacent leg portions defining a guide surface for holding a thread thereon and a loop interconnecting said legs at one end and extending away from said legs in a direction opposite to said guide surface.

16. In combination with a heating device of a textile machine having a heating surface; an apparatus for threading up and placing a thermoplastic thread in contact with said heating surface; said apparatus comprising at least one pin rigidly mounted above said heating surface for guiding a thread into contact with said heating surface;

at least one moveable thread guide element disposed for movement between a thread-receiving position located below said pin and a thread-transfer position located adjacent said pin, said moveable thread guide element including a pair of legs forming a guide for holding a thread thereon between said positions and a loop interconnecting said legs at one end, said legs being pivotal upon engagement of said loop with said pin in said thread-transfer position with said loop partially surrounding said pin in said thread-transfer position with portions of said legs being disposed above said pin to allow sliding of a thread therefrom onto said pin;

a member having said moveable thread guide element pivotally mounted thereon; and means for moving said member between said positions.

17. In combination with a heating device having a heating surface;

a hingedly mounted housing for selectively enclosing said heating-device;

at least one pin mounted above said heating surface;

at least one moveable thread guide element mounted on said housing for movement between a thread-receiving position located below said pin and a thread-transfer position located adjacent said pin with said housing in a closed position, said moveable thread guide element being pivotally mounted to pivot upon engagement with said stationary thread guide element and including a pair of legs forming a guide for holding a thread thereon and a loop interconnecting said legs at one end, said loop being sized to partially surround said pin in said thread-transfer position with portions of said legs disposed above said pin to allow sliding of a thread therefrom onto said pin; and means for moving said moveable thread guide element into said thread-transfer position to engage with said pin and to allow sliding of a thread from said moveable thread guide element to said pin.

18. In combination with a heating device of a textile machine having a heating surface; an apparatus for threading up and placing a thermoplastic thread in contact with said heating surface; said apparatus comprising a pin mounted adjacent said heating surface for guiding a loop of thread into contact with said heating surface;

a moveable thread guide element disposed for movement between a thread-receiving position located remote from said pin and a thread-transfer position located adjacent said pin;

a member having said moveable thread guide element pivotally mounted thereon to pivot between a first condition having the thread loop thereon and a second condition allowing the thread loop to move in a direction transverse to the plane of the thread loop onto said pin in said thread-transfer position, and means for moving said member between said positions.

* * * * *

UNITED STATES PATENT AND TRADEMARK OFFICE

CERTIFICATE OF CORRECTION

PATENT NO. : 4,171,201

DATED : October 16, 1979

INVENTOR(S) : Jakob Fluck, et al

It is certified that error appears in the above-identified patent and that said Letters Patent are hereby corrected as shown below:

Column 5, line 28, after "said" insert --first--

Signed and Sealed this

*First* Day of *January 1980*

[SEAL]

*Attest:*

SIDNEY A. DIAMOND

*Attesting Officer*

*Commissioner of Patents and Trademarks*